US007601243B2

(12) United States Patent
DeZutter et al.

(10) Patent No.: US 7,601,243 B2
(45) Date of Patent: Oct. 13, 2009

(54) METHOD FOR CONVEYING, MIXING, AND LEVELING DEWATERED PULP PRIOR TO DRYING

(75) Inventors: Ramon C DeZutter, Milton, WA (US); Christopher Q Tveter, Auburn, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 24 days.

(21) Appl. No.: 12/122,934

(22) Filed: May 19, 2008

(65) Prior Publication Data

US 2008/0216981 A1 Sep. 11, 2008

Related U.S. Application Data

(62) Division of application No. 10/674,609, filed on Sep. 29, 2003, now Pat. No. 7,396,435.

(51) Int. Cl.
*D21F 1/44* (2006.01)

(52) U.S. Cl. ..... 162/314; 162/52; 162/55; 162/56; 428/402; 428/532; 428/535

(58) Field of Classification Search ..... 162/314, 162/52, 55, 56, 28, 9; 428/402, 532, 535, 428/536

See application file for complete search history.

(56) References Cited

U.S. PATENT DOCUMENTS

| | | | |
|---|---|---|---|
| 4,036,679 | A | 7/1977 | Back |
| 4,226,027 | A | 10/1980 | Albus |
| 4,613,627 | A | 9/1986 | Sherman |
| 4,650,127 | A | 3/1987 | Radwanski |
| 5,176,793 | A | 1/1993 | Kurtz |
| 5,188,298 | A | 2/1993 | Gerber |
| 5,527,432 | A | 6/1996 | Leuthold |
| 5,564,635 | A | 10/1996 | Terada |
| 6,769,199 | B2 | 8/2004 | Vrbanac |
| 6,811,879 | B2 | 11/2004 | DeZutter |
| 2003/0093916 | A1 | 5/2003 | Vrbanac |
| 2003/0188449 | A1 | 10/2003 | Yancey |

FOREIGN PATENT DOCUMENTS

| | | |
|---|---|---|
| CA | 993618 | 7/1976 |
| CA | 1017519 | 9/1977 |

*Primary Examiner*—Mark Halpern
(74) *Attorney, Agent, or Firm*—John M. Crawford

(57) ABSTRACT

System for conveying, mixing, leveling, and flaking dewatered pulp to produce pulp flakes suitable to be used in a dryer. The system produces a consistent flow rate of pulp and uniform pulp flakes in terms of pulp flake size and pulp flake moisture content. The system includes a rotating shaftless screw conveyor for mixing and conveying dewatered pulp. The system includes a belt conveyor. The pulp is deposited from the screw conveyor onto the moving belt conveyor through a chute. The system includes a rotary doctor. The pulp is leveled with the rotary doctor located above the belt conveyor to produce a substantially even rate of mass flow of pulp along a length of belt conveyor. Uniform and consistent quantities of pulp per unit time can then be fed from the belt conveyor to a pulp flaker that then translates into an even rate of pulp mass flow to the dryer.

4 Claims, 6 Drawing Sheets

METHOD FOR CONVEYING, MIXING, AND LEVELING DEWATERED PULP PRIOR TO DRYING

CROSS-REFERENCE TO RELATED APPLICATION

This application is a divisional of U.S. patent application Ser. No. 10/674,609, filed Sep. 29, 2003, now U.S. Pat. No. 7,396,435, incorporated herein by reference.

BACKGROUND

A process to produce dried singulated cellulose pulp fibers is described in U.S. application Ser. No. 09/998,143 (hereinafter the '143 application), filed on Oct. 30, 2001, which is incorporated herein by reference in its entirety, and is assigned to the assignee of the present application. A representative schematic illustration of the process of the '143 application is provided herein as FIG. 8. One process described in the '143 application which is depicted in FIG. 8, uses a rotary airlock 60 interposed between a jet dryer 20 and the pulp feed system. The rotary airlock 60 comprises a single rotor with vanes.

However, it has been determined that the airlock described in the '143 application negatively affected the operation of the jet dryer, resulting in pulp fibers of uneven moisture content and high sonic knots. Furthermore, production capacity was limited as a result of the airlock. It has also been determined that the jet dryer described in the '143 application runs most efficiently when pulp mass flow, pulp particle size, and pulp moisture content are controlled within certain parameters, which the rotary airlock was unable to accomplish. The rotary airlock was incapable of metering pulp to the degree necessary to produce an even mass flow rate of feed pulp to the dryer. The problem with the rotary airlock was that there were unequal volumes of pulp in the cavities between vanes, which caused the dryer to oscillate or "pulse" because of the timed deposits of the unequal volumes introduced into the dryer loop. The pulp came in bundled amounts; therefore, the moisture content of the pulp was unevenly distributed throughout each bundle. The air lock cavities between the vanes were too small and would fill up, causing the rotor to jam due to the pulp bundles being caught between the rotor vane and the rotor housing. Furthermore, the use of the airlock would cause the dryer to surge, thereby also contributing to the fibers having unacceptable varying moisture content. Accordingly, there is a need to provide for an improved method and apparatus to feed a jet dryer. The present invention overcomes the problems with the rotary airlock and has further related advantages.

SUMMARY

The present invention is related to methods for conveying, mixing, leveling, and flaking dewatered pulp to produce pulp flakes suitable to be used in the jet dryer described in the '143 application. The present invention is also related to a method for producing a consistent flow rate of pulp and for producing uniform pulp flakes in terms of pulp flake size and pulp flake moisture content. One embodiment of a method includes introducing a dewatered pulp to a rotating shaftless screw conveyor. The rotating shaftless screw conveyor can simultaneously mix and convey the pulp along a length of the screw conveyor. The pulp is deposited from the screw conveyor onto a moving belt conveyor via a chute. The chute retains the pulp, prevents scattering of the pulp on the belt conveyor, and results in a pulp pile of uniform width. Even with the use of a chute, when the pulp is deposited from the chute onto the belt conveyor, the pulp can form uneven quantities of pulp along a length of belt conveyor due to the nature of the rotating shaftless screw conveyor design, and can result in the pulp having a sinusoidal profile. The pulp is flattened out, or leveled, with a rotary doctor located above the belt conveyor to produce a substantially even rate of mass flow of pulp along a length of belt conveyor. Substantially even, uniform, and consistent quantities of pulp per unit time can then be fed from the belt conveyor to a pulp flaker that translates into an even rate of mass flow to the jet dryer. The pulp flaker can reduce the size of the pulp into pulp flakes of consistent or uniform size.

Another embodiment of the present invention is used for producing pulp flakes. The method includes introducing dewatered pulp to a pulp flaker. The pulp flaker has rotating first and second rotors, wherein the rotors are rotating in opposite directions at a differential speed. Each of the rotors includes a plurality of fingers that are arranged circumferentially and longitudinally along the rotors. As the rotors rotate, the fingers of one rotor pass interspaced between the fingers of the second rotor in the region between rotors.

Another embodiment of the present invention is related to a pulp flaker. The pulp flaker includes a housing configured with an inlet and an outlet for allowing the introduction and discharge of pulp to and from the pulp flaker. The pulp flaker includes a first and second rotor housed within the housing. The rotors are configured parallel to one another inside of the housing. Each rotor is provided with a plurality of fingers, wherein the fingers are arranged circumferentially and longitudinally on the rotors. Each finger has a leading edge. As the rotors rotate, the fingers of one rotor pass interspaced between the fingers of the second rotor in the region between rotors. In one embodiment of a pulp flaker, three dimensions are designed to be within a specified range. These are: the distance between the leading edges on the ends of the fingers to the housing, the distance from the leading edges on the ends of the fingers to the opposing rotor, and the distance from the fingers of one rotor to the fingers of the opposing rotor as the fingers of the first rotor pass between the fingers of the second rotor. The three distances can be approximately the same to one another or independently different to one another. The distances can be approximately one-eighth of an inch or less. The rotors are configured to operate at a speed differential. At least one rotor is rotating at a speed of about 500 rpm (revolutions per minute) to about 3600 rpm. The second rotor is configured to rotate at approximately one-third the speed of the first rotor; however, the second rotor can rotate anywhere in the range of about one-tenth to about nine-tenths the speed of the first rotor. The fingers are configured with at least one leading edge that can impact the pulp as it enters the flaker housing. In a different configuration, each finger can have two leading edges.

Another embodiment of the present invention is related to a system and method for producing singulated pulp fibers. The system includes a shaftless screw conveyor for mixing and conveying dewatered pulp. The system includes a belt conveyor configured to receive the pulp from the shaftless screw conveyor. The system includes a chute and rotary doctor located above the belt conveyor for leveling the pulp that is deposited on the belt conveyor to provide a substantially even rate of mass flow of pulp along a length of belt conveyor. The system includes a pulp flaker configured to receive a substantially even rate of mass flow of pulp from the belt conveyor. The pulp flaker produces pulp flakes of uniform size and moisture content and at an even rate of mass flow, to a dryer. The system includes a jet dryer configured to receive pulp from the pulp flaker to produce the dried singulated pulp fibers.

The present invention thus provides a consistent rate of mass flow of pulp for dryers. The pulp flakes leaving the flaker are, on average, consistently about one-sixteenth to about one-half of an inch in size. As a result, the moisture content of the pulp flakes varies less with the methods described herein as compared with the airlock.

The singulated pulp fibers and pulp flakes made in accordance with the present invention have many end uses, such as in animal bedding, reinforcing fibrous materials in cementitious products, sponges, and insulation.

The present invention is related to a system for producing a consistent flow rate of pulp and for producing uniform pulp flakes in terms of size and moisture content. This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
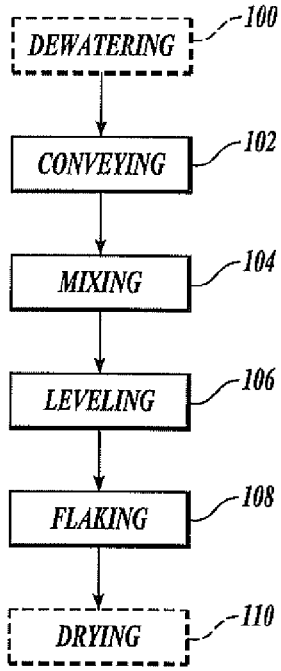
FIG. 1 is a schematic flowsheet of a process for conveying, mixing, leveling, and flaking dewatered pulp suitable for drying according to the present invention.
Figure 8:
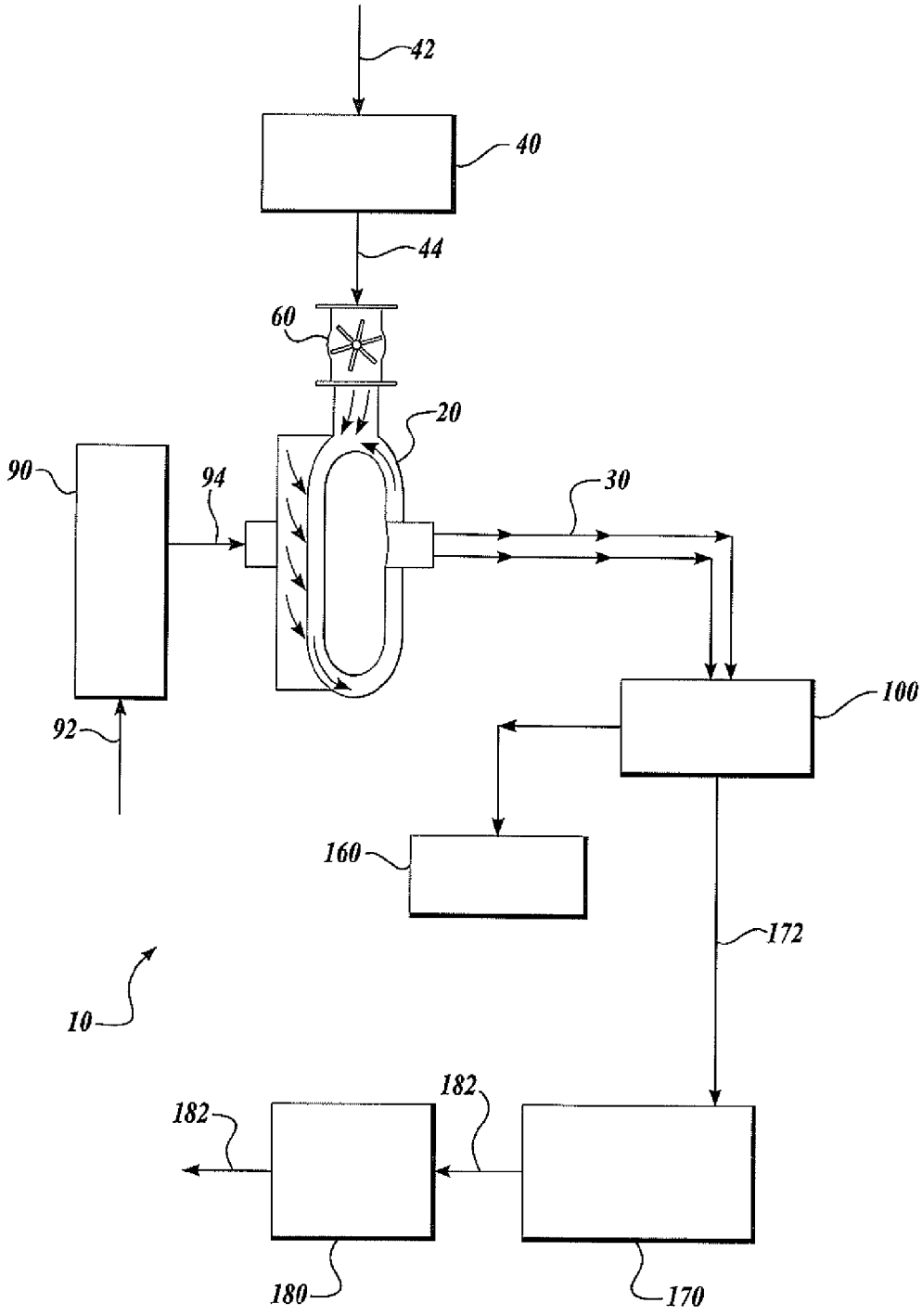
FIG. 8 is a schematic illustration of the process of the '143 application.

Referring to FIG. 1, the present invention is related to methods for conveying 102, mixing 104, leveling 106, and flaking 108, dewatered pulp into pulp flakes of uniform small size and moisture content to improve the operation of a dryer. In the '143 application referred to above, an airlock was used immediately prior to a jet dryer. The airlock proved unsatisfactory. "Jet drier" as used herein means any dryer that accelerates air into a loop conduit enabling the simultaneous drying and singulation of a substance flowing through the conduit. Reference is made to the '143 application for a fuller description of jet dryers and their operation. FIG. 1 of the '143 application (provided as FIG. 8 herein) shows a shaftless screw conveyor 40, followed by an airlock 60 which then feeds pulp into the jet dryer 20. According to one embodiment of the present invention, in place of the airlock 60, a belt conveyor with a leveling apparatus and a pulp flaker are substituted for the airlock 60. The product leaving the pulp flaker can be fed to a pulp dryer, such as the jet dryer described in the '143 application to produce singulated pulp fibers. Alternatively, the methods described herein can be practiced apart from the system of the '143 application. In this instance, rather than use the prior system and methods to feed a dryer, the pulp flakes leaving the pulp flaker are the desired product. The present invention advantageously provides an even mass flow rate of pulp flakes; the pulp flakes are, on average, consistently a uniform size from about one-sixteenth of an inch to about one-half of an inch, and the pulp flakes have a uniform moisture content throughout.

Referring again to FIG. 1, dewatering step 100 is optional. If used, however, a suitable pulp dewatering apparatus is a screw press. However, because of the compression involved in the screw press, the pulp tends to clump together as it exits the screw press, and the need arises to break the pulp into smaller sized masses. The prior rotary airlock is not capable of providing the optimal mass flow rate of pulp feed and pulp size to the jet dryer, thus, the dryer operation is compromised. It is theorized that jet dryer operation can be improved by providing a consistent mass flow of pulp to the dryer, wherein the pulp has a low variability of moisture content, and pulp is fed in uniform and consistent, but small, particulate sizes. Accordingly, pulp leaving a rotary airlock tends to be less suitable to be fed into a jet dryer. Other suitable dewatering devices include belt presses, continuous centrifuges, and double roll presses.

The present invention overcomes the problems of the rotary airlock and provides a process to mix and convey pulp, provide uniform pulp size, and consistent pulp mass flow to a dryer. The conveying and mixing steps 102 and 104, respectively, although shown as discrete blocks, can be accomplished simultaneously, or discretely. One embodiment of a process according to the present invention provides for simultaneously conveying and mixing dewatered pulp coming from a dewatering operation 100. It is to be appreciated, however, that dewatering step 100 can be omitted if the pulp is obtained with the desired moisture content. In one embodiment of the present invention, the simultaneous conveying and mixing of dewatered pulp is accomplished with a shaftless screw conveyor. Besides shaftless screw conveyors, other type mixers may be suitable to initially break up the pulp clumps leaving the screw press dewatering operation 100. If a shaftless screw conveyer is utilized, the pulp exiting from the shaftless screw conveyor can be deposited onto a belt conveyor. However, shaftless screw conveyors unevenly deposit the pulp along the length of the moving belt conveyor due to the sinusoidal nature of the shaftless screw conveyor operation.

In order to overcome the uneven distribution of pulp produced by the shaftless screw conveyor, a chute and rotary doctor can be provided to level and shape the pulp into even quantities of pulp along the belt conveyor. The chute can be located at the discharge of the shaftless screw conveyor that is closely coupled to the belt conveyor. The chute retains the pulp to within a specific area on the belt conveyor so that the discharged pulp falls from the shaftless screw conveyor onto the belt conveyor in a pile having a substantially uniform width. The chute is mechanically configured with the correct opening size to provide the predetermined width to the deposited pulp. Even with the use of a chute, the pulp can be distributed unevenly onto the belt conveyor, taking the form of peaks and valleys. A rotary doctor can be used as a trim device to trim the height of the pulp, and to smooth, or level any peaks. The pulp width is set mechanically by the chute opening and the pulp height on the belt conveyor can be set by controlling the speed of the belt conveyor or by adjusting the rotary doctor height. A slower belt conveyor speed results in a higher pile of pulp, and a faster belt conveyor speed results in a lower height of pulp.

"Leveling" refers to creating a flat, smooth or even top surface of the pulp pile along a length of belt conveyor. A combination of the chute and rotary doctor can perform the leveling function. This leveling results in a substantially even rate of pulp mass flow from the belt conveyor to the pulp flaker, and eventually translates into a uniform, consistent rate of mass flow to the jet dryer. Leveling is intended to encompass all forms of providing consistent even rates of mass flow, wherein in one embodiment, a chute in combination with a rotary doctor can be used to level the pulp.

Figure 2:
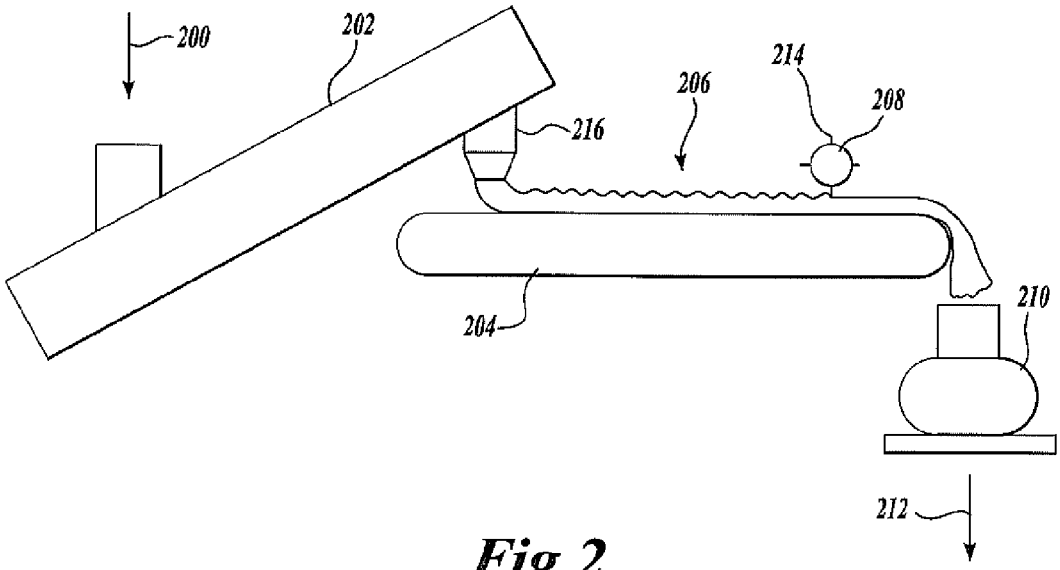
FIG. 2 is a schematic illustration of a system for conveying, mixing, leveling, and flaking dewatered pulp suitable for drying according to the present invention.

Referring now to FIG. 2, a system for conveying, mixing, leveling, and flaking pulp, is illustrated. The system includes a shaftless screw conveyor 202, a belt conveyor 204 configured to receive pulp from shaftless screw conveyor 202. The system includes a chute 216 located at the outlet of the shaftless screw conveyor to initially provide some degree of pulp width and height control. The system includes a rotary doctor 208 located above belt conveyor 204 to trim the pulp peaks. The height of the rotary doctor 208 above the belt conveyor 204 is adjustable. The system includes a pulp flaker 210, which is configured to receive the substantially even rate of mass flow of pulp produced from the belt conveyor 204. Thus, the pulp flaker 210 can provide pulp flakes 212 of consistent and/or uniform size and/or moisture content at a substantially even rate of mass flow. The pulp flakes 212, thus produced, are suitable for drying, such as in the jet dryer in the aforementioned '143 application. In one embodiment, the belt conveyor 204, chute 216, rotary doctor 208, and pulp flaker 210 described above can be incorporated into the system in the aforementioned '143 patent application, as a substitute for the airlock 60. A shaftless screw conveyor is disclosed in the prior '143 application.

In another embodiment, the shaftless screw conveyor, belt conveyor, chute, and rotary doctor can be omitted from the system, and the dewatering device can feed directly to the pulp flaker 210. This would be desirable in the case where a pulp flake is the desired product as opposed to the singulated pulp fibers produced in accordance with the previous '143 application. Such pulp flakes find many uses, including fibrous agents in cementitious products, as animal bedding material, as insulation, or used to make sponges. To produce animal bedding, or any of the other products, it may be desirable to increase one or more of the three distances relating to the design of the pulp flaker to be more than one-eighth of an inch. The distances are described in greater detail below, for now these are: the finger to finger distance, the finger to rotor distance, and the finger to housing distance.

Furthermore, the pulp flaker 300, in accordance with the invention, may feed dryers other than jet dryers.

The pulp 200 fed to the shaftless screw conveyor 202, may be bleached pulp, unbleached pulp, mechanical pulp, chemical pulp, dissolving grade pulp, once-dried and reslurried pulp, recycled pulp, or any other pulp type. Typically, the dewatering device will have removed a portion of the water from pulp to increase the consistency of the feed pulp 200 to anywhere in the range of about 10% to about 55%. Preferably, however, the consistency of the pulp 200 should be about 30% to about 50%. The dewatered pulp 200 may be treated in a manner similar to the treatments described in the aforementioned '143 application. The treatment agents may include, but are not limited to surfactants, crosslinking agents, hydrophobic agents, mineral particulates (such as gypsum), superplasticizers, foams, and other materials to impart specific end user fiber properties. Reference is made to the '143 application for a listing of representative treating agents and for a description of methods of treating.

The shaftless screw conveyor 202 has a shaftless screw housed within and configured to rotate in a housing. The shaftless screw conveyor feeds wet pulp at an incline that rises above a belt conveyor 204 so that the shaftless screw conveyor outlet deposits the pulp into the chute 216 that directs the pulp to the upper surface along a length of the belt conveyor 204.

As shown in FIG. 2, the belt conveyor 204 has an upper horizontal conveyor run extending at least from the outlet of the chute 216 to the inlet of the pulp flaker 210. The belt conveyor 204 is configured to receive pulp from shaftless screw conveyor 202 and deposit the pulp to pulp flaker 210. Belt conveyor 204 can be of conventional design. Pulp 206 deposited on belt conveyor 204 from shaftless screw conveyor 202 would form an alternating series of high peaks and lower valleys. According to the invention, it is desirable to provide a substantially even rate of mass flow of pulp to a dryer. One suitable apparatus to smooth out the peaks and valleys to provide a substantially even rate of mass flow leaving belt conveyor 204, is to provide the retaining chute 216, followed by the rotary doctor 208 located above belt conveyor 204. The chute 216 can be designed with an opening at a lower portion thereof. The opening is dimensioned approximately to the desired width of the pile of pulp. The rotary doctor 208 comprises a rotating shaft or drum configured with longitudinal vanes or paddles 214 aligned parallel to the drum's longitudinally rotating axis. The drum's longitudinal axis is perpendicular to the forward line of motion of the belt conveyor. The paddles or vanes can be fixed at regular intervals longitudinally along the outer perimeter of the drum. The drum rotation can be synchronized with the rotation of the shaftless screw conveyor or the forward motion of the belt conveyor so that the vane motion can achieve a smooth, even surface. The height of the rotary doctor 208 above the belt conveyor upper surface 204 can be adjusted to increase or decrease the rate of mass flow. Smooth, flat, or level pulp quantities are produced to the right of the rotary doctor, and along a length of belt conveyor. As an alternative to the rotary doctor, a stationary blade can be located above the belt conveyor. The pulp leaves the belt conveyor 204 and is deposited into pulp flaker 210 at a uniform, or even, rate of mass flow. The pulp flaker according to the invention can reduce the size of the pulp, on average, to about one-sixteenth to about one-half of an inch. The size is determined by, among other things, rotor speed, finger design, and spacing.

Figure 3:
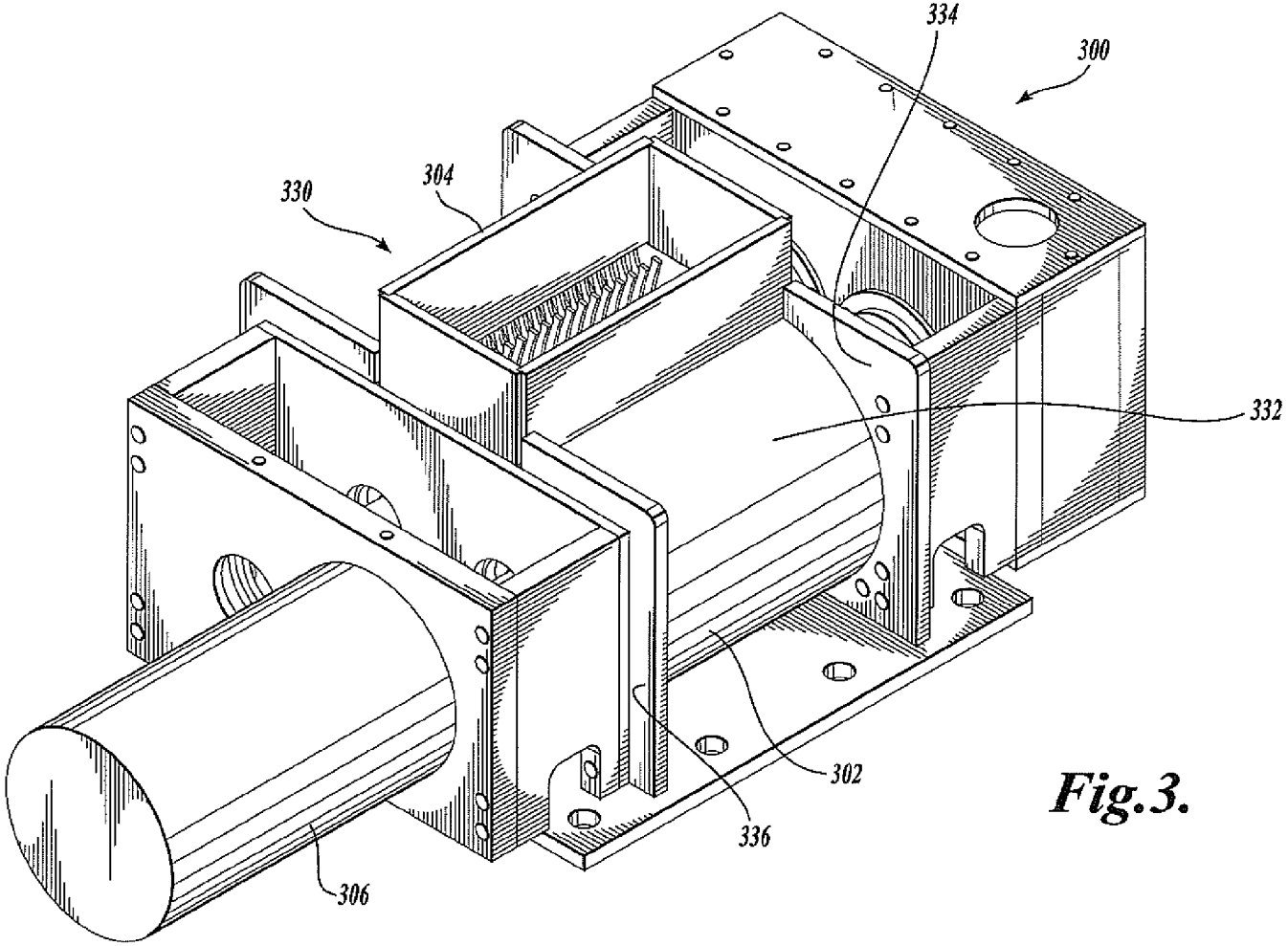
FIG. 3 is a perspective illustration of a pulp flaker according to the present invention.

Referring now to FIG. 3, one embodiment of a pulp flaker 300 according to the present invention, is illustrated. The pulp flaker 300 includes a housing 302, which is designed to be in close tolerance with the rotors housed within. The housing 302 comprises two semicircular housing members 330, 332 spaced from each other to provide openings for an inlet and an outlet at top and bottom positions, respectively. It is to be appreciated that the use of directional language in this application, such as top, bottom, upper, lower, left, right, horizontal, vertical is with respect to the figures. In practice, the apparatus may be oriented differently from the orientations shown to the figures. Cover plates 334, 336 are placed on either side of the semicircular housing members. The cover plates may be provided with the necessary openings for rotor shafts, supporting bearings, drivers, gears, and/or one or more driver shafts. Further additional supporting structure may be added to the pulp flaker as required by the pulp flaker's location or placement. Rotors (minimally visible in FIG. 3) are assemblies comprising at least a shaft and a plurality of fingers fixed to the shaft. The pulp flaker 300 includes an inlet box 304 coupled with an opening in the housing to allow pulp to fall on the rotating rotors inside. The inlet box 304 is located at a central location to direct the pulp to the rotors. A chute (not shown) can be provided as a transition piece between the belt conveyor 204 and the pulp flaker inlet box. An outlet (338 in FIG. 4) is located on the underside of the pulp flaker 300 and coupled to an opening in the housing to allow the pulp to be discharged from the housing to any downstream equipment. The outlet can be configured to mate with the inlet of any suitable dryer so as to transfer the pulp flakes produced by the pulp flaker, to the dryer.

The pulp flaker 300 includes a driver 306. The driver shaft (not shown) is coupled directly or indirectly through gears to at least one first rotor within housing 302. A second rotor can be coupled to an independent driver, or alternatively, can be coupled to the same driver 306 with or without a reduction or increase in gear ratio. First and second rotors are configured to rotate at a specified speed differential, and in opposite directions. Opposite directions means that one rotor turns clockwise and one rotor turns counterclockwise. At least one rotor is configured to rotate at a speed from about 500 rpm to about 3600 rpm. This rotor is referred to as the "full speed rotor." The speed of the full speed rotor is dependent on the type of pulp, shape and size of pulp bundles, and processing times. The second rotor is configured to operate at a reduced ratio that is one-tenth to nine-tenths the speed of the full speed rotor. The rotor that operates at a reduced speed is referred to as the "off speed rotor." The off speed rotor may additionally function to clean the full speed rotor to allow uniform feed throughput. In one embodiment, the preferred speed of rotation for the second or off speed rotor is about one-third the speed of the full speed rotor. It is theorized that rotors operating at about a 3 to 1 speed ratio optimally produce the pulp in the desired flake size range suitable for a dryer, such as a jet dryer.

Figure 4:
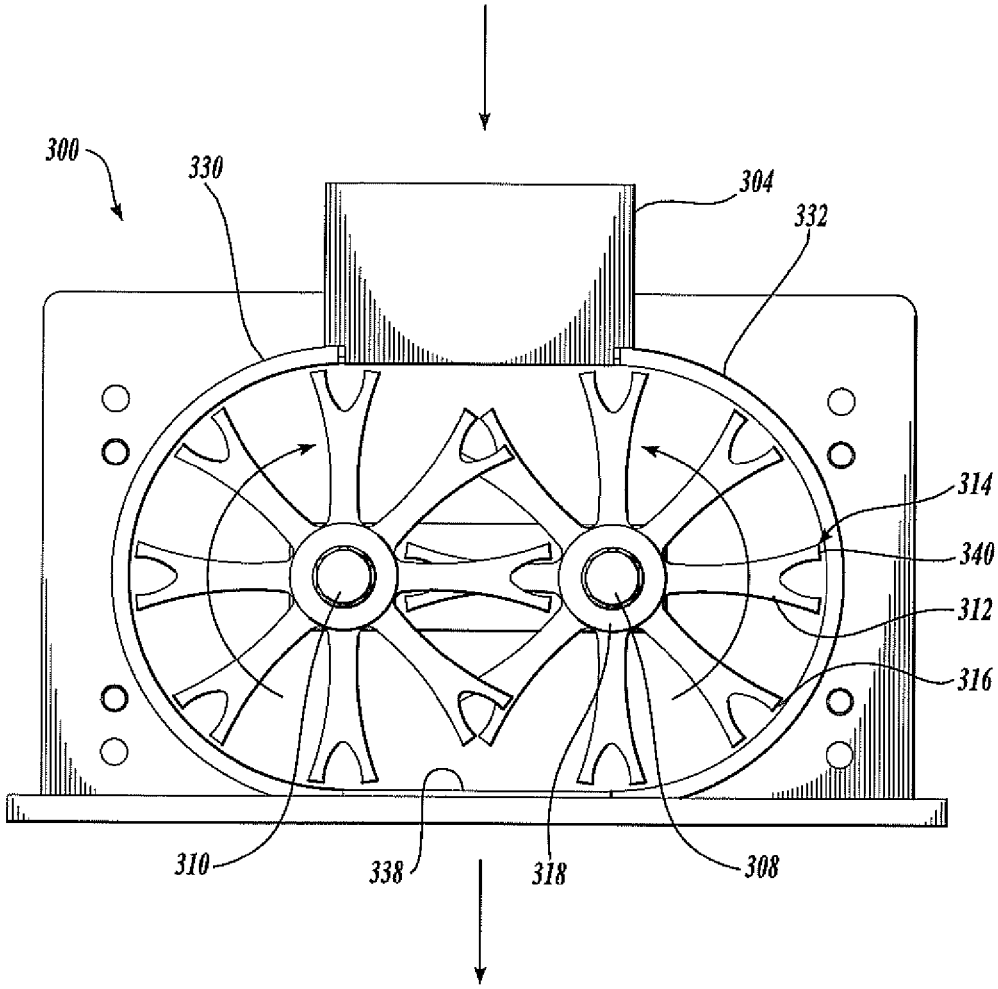
FIG. 4 is a cross-sectional illustration of the pulp flaker according to the present invention.

Referring now to FIG. 4, a cross sectional illustration of the pulp flaker 300 with one cover plate removed clearly shows first and second rotor relationship, 308 and 310 respectively, and the semicircular housing members 330 and 332 that enclose them.

As shown in FIG. 4, rotor 308 and rotor 310 include a plurality of fingers 312, attached to the respective shafts of rotors. The fingers on each of the rotors are uniformly distributed circumferentially around the perimeter of the rotor shaft. For ease of manufacture, a flat plate can be used to produce each set of eight fingers. Fingers 312 can be formed attached to a central hub 318 with an opening, wherein the hub 318 then can be press fitted on the shaft and fixed in place. Spacers integral with the hub, or as separate components, are provided between hubs on a shaft to provide a finger to finger space between adjacent sets of fingers. The space between fingers allows the fingers of the opposing rotor to pass in the space with a desired clearance on either side. The number of sets of fingers on any one shaft can be varied according to the design and/or capacity of the pulp flaker. Sets of fingers on any one rotor may be fixed at the same angle on the rotor or each set may be offset at an angle from the adjacent sets. When the two assembled rotors are mounted within the housing, an alternating pattern of fingers is produced, whereby fingers on one rotor are interspaced with the fingers on the second rotor. The interspaced finger configuration is more clearly shown in FIG. 6.

Various configurations of fingers are possible. Finger configuration is designed to impact the pulp in a manner to produce flakes in the desired size range. Fingers on both rotors include at least one leading edge 314, whereby upon rotation the leading edge passes in close proximity to the inner surface of one of the semicircular housing members 330 and 332. The clearance distance 316 between the leading edge of fingers and the semicircular housing is designed to produce pulp in the particulate size desired, typically in the range of about one-sixteenth of an inch to about one-half of an inch, on average. The leading edge 314 of fingers 312 is not spaced so far apart from the semicircular housing, so as to merely roll or push the pulp around the housing without significant breaking up of the pulp. In one embodiment, the clearance distance 316 between the leading edge 314 and the housing is about one-eighth of an inch or less.

In one embodiment of a pulp flaker finger 312, the finger is symmetrical with respect to an axis line extending along a radius line from the rotor center. Two leading edges are provided on each finger on either side of the axis line. A space is provided between the leading edges. The effect of this design is to double the number of impacts, while operating at a lower rpm. It is believed that increasing rpms beyond an upper limit will have a negative effect on the pulp. Too high an rpm will result in the pulp fiber integrity being compromised. At the same time, the rpm of the full speed rotor is not so low so as to cause unacceptably large pulp particulates leaving the flaker. The rpm of the full speed rotor is from about 500 rpm to about 3600 rpm.

Figure 7:
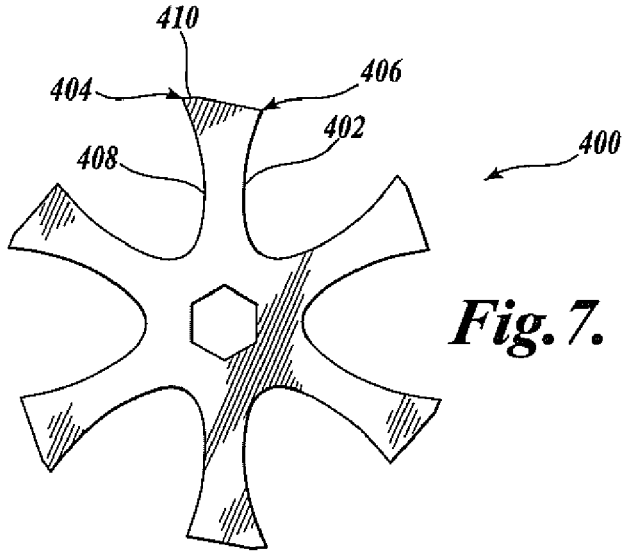
FIG. 7 is an illustration of one embodiment of a pulp flaker finger according to the present invention.

An alternative design for a pulp flaker finger plate 400 is illustrated in FIG. 7. In this embodiment, there are 6 fingers compared to the 8 fingers of the embodiment shown in FIG. 4. Furthermore, each of the fingers 402 has a single leading edge 404. The finger has a trailing edge 406 that has a greater clearance distance as it passes by the semicircular housing portion. It is believed the reduction in clearance distance at the trailing edge will avoid the effect of rolling and/or pushing the pulp along the housing without significant breakdown. Another feature of the pulp flaker finger of FIG. 7 is the curved "scoop" design 408 of the finger edge heading in the direction of rotation. The scoop design is intended to scoop up the pulp in the spaces between fingers and fling the pulp towards the outer edges, where the leading edges will impact with the pulp.

Referring back to FIG. 4, as the rotors 308 and 310 rotate in opposite directions, as indicated by the curved arrows, the leading edges of fingers of one rotor will pass nearest to the opposite rotor when the fingers are slightly at an angle before being horizontal. This is because the leading edges are offset from the center axis on each finger. As the rotors rotate, the fingers of one rotor pass interspaced between the fingers of the opposite rotor in the region between rotors. The clearance distance (320 in FIG. 6) between the leading edge of the fingers of one rotor and the opposite rotor can be about the same as the distance between the leading edge of the fingers and the semicircular part of the housing. In one embodiment, the distance from the leading edge when the fingers pass the nearest point to the opposing rotor (i.e., the fingers pass by the spacers of the opposing rotor), is approximately one-eighth of an inch or less. Note that the leading edges are at the nearest point to the opposing rotor immediately before the finger reaches the horizontal position, when the longitudinal axis of the finger is in the line defined by the center points of the rotors.

Figure 5:
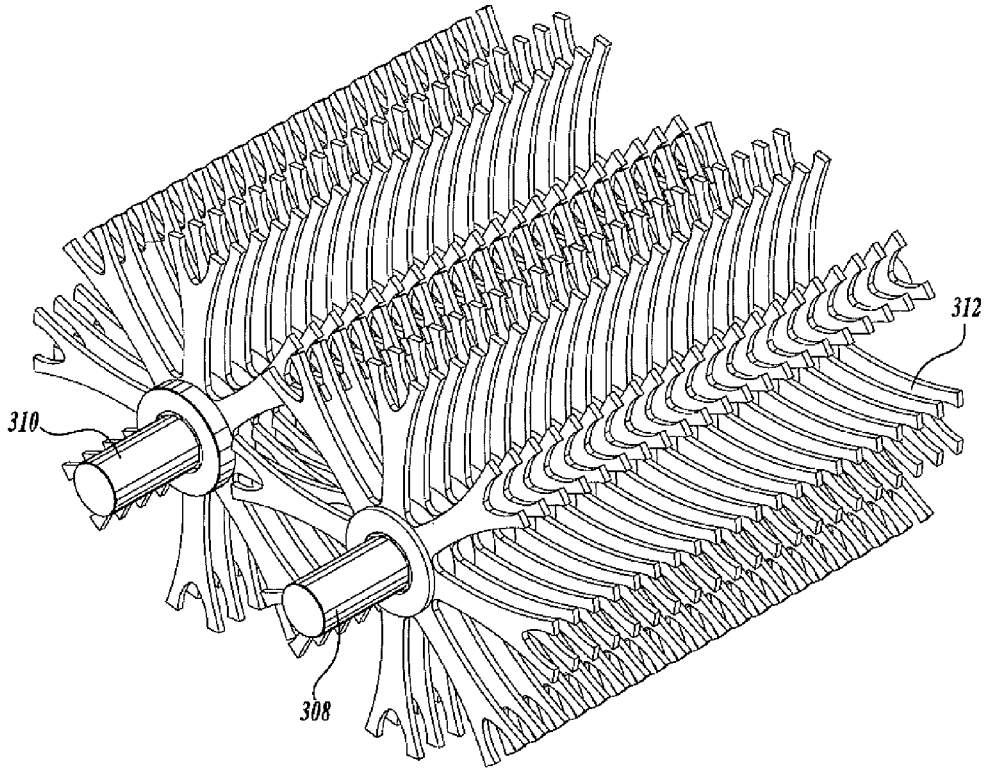
FIG. 5 is a perspective illustration of the first and second rotors for a pulp flaker according to the present invention.

Referring now to FIG. 5, the two rotors 308, 310, are shown in isolation from the housing, thus showing the fingers both circumferentially and longitudinally arranged on each rotor. The intermeshing of the fingers of one rotor with the fingers of the opposing rotor as the fingers pass one another in the region between rotors is clearly apparent. The pulp feed is deposited from above in the region between rotors. The pulp is immediately diminished in size in the section between rotors, where the fingers of one rotor pass in close proximity to the fingers of the second rotor.

The longitudinal distance (324 in FIG. 6) between the fingers of one rotor and the adjacent fingers of the opposite rotor, on either side, is about the same as the distance 320 between any leading edge as it passes the nearest point of the opposing rotor. The distance is also approximately the same distance as the clearance distance 316 between the leading edge and the semicircular portion of the housing. In one embodiment, the longitudinal distance between one finger of one rotor and the adjacent finger of the opposing rotor is approximately one-eighth of an inch or less. Three distances affecting finger design, and consequently pulp size, have been described. These three distances are: the longitudinal distance between the finger of one rotor and the adjacent finger of the opposing rotor as the fingers pass interspaced between the region between rotors (finger to finger distance), the distance between the leading edge of a finger as it passes to the nearest point of the opposing rotor (finger to rotor distance), and the distance of the leading edge of a finger to the semicircular portion of the housing (finger to housing distance). In one embodiment, the three distances are approximately the same to one another, the distance being approximately one-eighth of an inch or less. However, it is to be appreciated from a reading of this disclosure, each of the distances can be independently different to each other.

The selected clearance distance between the leading edges and the opposing rotor, the clearance distance between the fingers as they pass one another, and the clearance distance between the fingers as they pass the semicircular housing portion, enables the pulp to be processed by the flaker without damaging cellulose fibers or jamming the flaker. Additionally, the ends of the fingers have a flat spot 340 of specific width, the width being perpendicular to a radius line from the rotor. The pulp flaker finger embodiment of FIG. 7 also includes a flat spot 410. It is believed that the flat spots of the fingers reduce the amount of material that gets pushed around the housing and also reduces the wear on the fingers.

Figure 6:
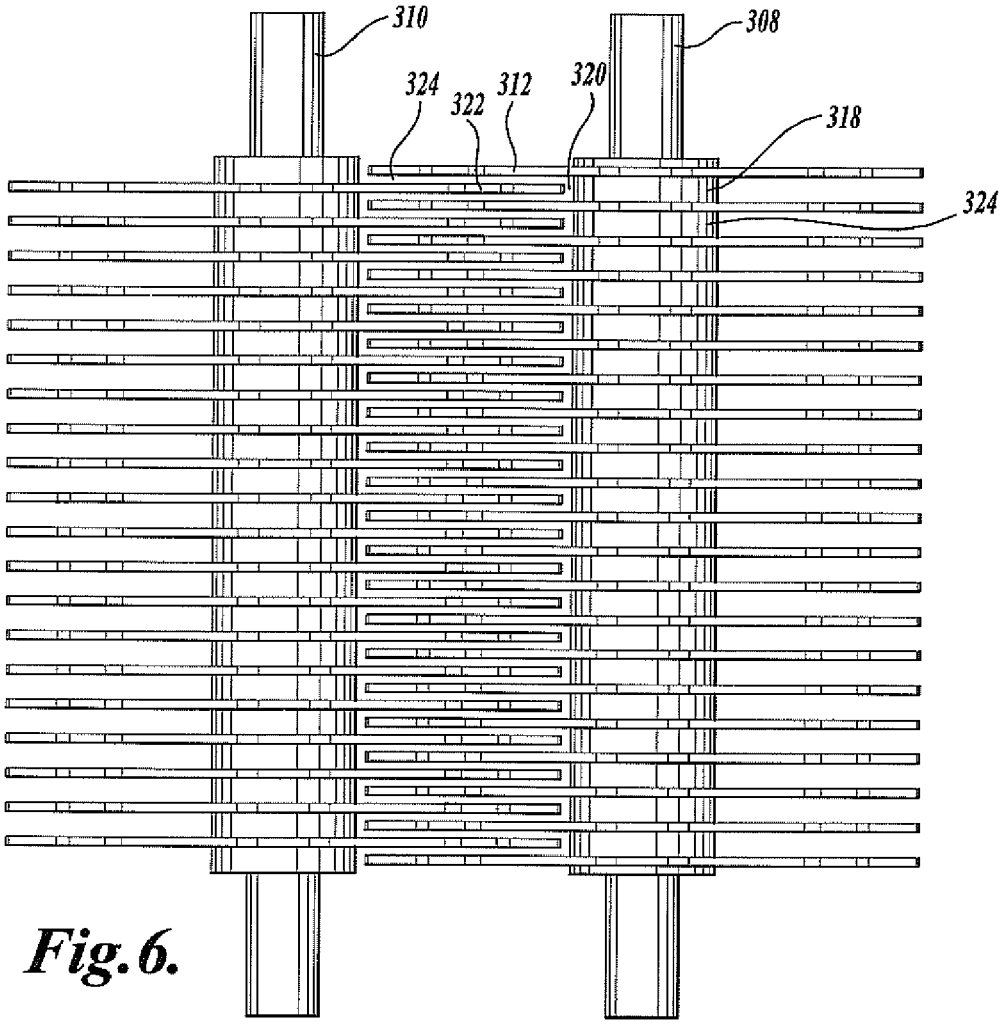
FIG. 6 is a top view illustration of the first and second rotors for the pulp flaker according to the present invention.

Referring now to FIG. 6, the top view of the rotors 308 and 310 shown in isolation in FIG. 5, is illustrated. As can be seen in FIG. 6, the section between rotors 308 and 310 is configured to close tolerances to produce the required pulp size reduction. Not only is there a close tolerance distance between the leading edges and the housing, but there is also a close tolerance distance 324 between alternating fingers 312 of rotor 308 and fingers 322 of rotor 310. The clearance distance 320 between the leading edge of fingers of rotor 310 to the opposing spacer 318 on rotor 308 is visible; as is the clearance distance 324 between the fingers of rotor 310 and the fingers of rotor 308. As can be seen, the pulp entering the pulp flaker from above the rotating fingers is subjected to efficient impacting and shearing forces to reduce the incoming pulp size to a substantially uniform size in the range of about one-sixteenth to about one-half of an inch, or less, on average.

While illustrative embodiments have been illustrated and described, it will be appreciated that various changes can be made therein without departing from the spirit and scope of the invention.

The embodiments of the invention in which an exclusive property or privilege is claimed are defined as follows:

1. A system for producing singulated pulp fibers, comprising:

a shaftless screw conveyor for mixing and conveying dewatered pulp;

a belt conveyor configured to receive the pulp from said shaftless screw conveyor;

a rotary doctor located above said belt conveyor for leveling the pulp deposited on said belt conveyor into substantially even quantities of pulp along a length of belt conveyor;

a pulp flaker configured to receive a substantially even rate of mass flow of pulp from said belt conveyor; and a jet drier configured to receive said pulp from said pulp flaker.

2. The system of claim 1, wherein the pulp flaker comprises:

a housing configured with an inlet and an outlet;

a first and second rotor within said housing, said rotors parallel to one another; and a plurality of fingers on each of said rotors, said fingers circumferentially and longitudinally arranged on said rotors, wherein the fingers of one rotor pass interspaced between the fingers of the second rotor in the region between rotors.

3. The system of claim 1, wherein said rotary doctor height above the belt conveyor is adjustable.

4. The system of claim 1, wherein said pulp flaker has at least two rotors, said rotors configured to rotate in opposite directions at a speed differential.

* * * * *